US005586360A

United States Patent [19]

Diederiks, Jr. et al.

[11] Patent Number: 5,586,360

[45] Date of Patent: Dec. 24, 1996

[54] ATTACHMENT FOR PNEUMATIC CLEANING DEVICE

[75] Inventors: Everett G. Diederiks, Jr., Lake Ridge, Va.; Edwin E. Puett, Jr., Stuart, Fla.

[73] Assignee: Anser Tool & Machinery Technologies, Inc., Stuart, Fla.

[21] Appl. No.: 498,053

[22] Filed: Jul. 5, 1995

[51] Int. Cl.[6] ..... A47L 9/02; A47L 9/32

[52] U.S. Cl. ..... 15/410; 15/414

[58] Field of Search ..... 15/328, 410, 414, 15/415.1

[56] References Cited

U.S. PATENT DOCUMENTS 2,623,234 12/1952 Brown .
5,056,187 10/1991 Higgins .
5,195,209 3/1993 Watkins .

*Primary Examiner*—David Scherbel
*Assistant Examiner*—Terrence R. Till
*Attorney, Agent, or Firm*—Everett G. Diederiks, Jr.

[57] ABSTRACT

A pneumatic cleaning device attachment includes an elongated, rigid tubular section, a flexible tubular section and a rigid tubular end piece that are connected together in series. The rigid and flexible tubular sections, as well as at least a portion of the end piece, have generally commensurate inner and outer diameters. A tubular, rigid cover member, having an associated length greater than an associated length of the flexible tubular section and an associated inner diameter that is greater than the diameters of the rigid and flexible tubular sections, is slidable mounted between a first position wherein the cover member extends between the rigid tubular section and the end piece in order to maintain the flexible tubular section in a straight posture and a second position wherein the cover member extends about the rigid tubular section such that the flexible tubular member is exposed. The attachment is further provided with a handle member which is detachably mounted to the rigid tubular section. When the cover member is placed in its second position, the handle member can be used to maintain the flexible tubular section in a curved posture.

19 Claims, 2 Drawing Sheets

ATTACHMENT FOR PNEUMATIC CLEANING DEVICE

BACKGROUND OF THE INVENTION

1. Field of the Invention

The present invention pertains to the art of pneumatic cleaning devices, such as vacuum cleaners, blowers and the like and, more particularly, to a versatile attachment for use with vacuum cleaners, blowers and the like.

2. Discussion of the Prior Art

There have been numerous attachments proposed in the past for use with different types of pneumatic cleaning devices. For example, it has been heretofore been proposed to provide a wet/dry vacuum attachment that defines a rigid tubular member that includes a curved end portion that enables the attachment to be used in cleaning rain gutters. Such prior art attachments are disclosed, for example, in U.S. Pat. Nos. 2,623,234, 5,056,187 and 5,195,209. It is also known to provide an elongated, substantially linear tubular attachments for use on blowers for leaves and other debris. Finally, it is commonplace to provide flexible tubular attachments for other types of cleaning devices, such has household vacuums.

Each of these known types of attachments for pneumatic cleaning devices is specifically designed for a particular purpose with respect to a given cleaning device. For this reason, the rigid tubular attachments evince certain desired characteristics that are not found in the flexible tubular attachments and vice-versa. Therefore, these known attachments lack versatility due to their structure. For example, the rigid tubular attachments disclosed in the above-identified '187 and '209 Patents enable the attachments to retain a desired curvature in order to effectively be used to clean gutters. However, these rigid attachments would provide inferior results to a flexible tubular attachment when cleaning in other environments, such as around varying shaped objects and in tight places.

Therefore, there exists a need in the art for an attachment for a pneumatic cleaning device which is versatile such that it can be effectively used in cleaning environments which require a rigid tubular member, as well as environments which dictate the need for a flexible tubular cleaning attachment.

SUMMARY OF THE INVENTION

The present invention is directed to an attachment for a pneumatic cleaning device that can be selectively configured as either a rigid tubular cleaning attachment or a flexible cleaning attachment in order to enable the attachment to used effectively in performing a wide range of cleaning tasks.

According to a preferred embodiment of the invention, the pneumatic cleaning device attachment includes an elongated, rigid tubular section, a flexible tubular section and a rigid tubular end piece that are connected together in series. The rigid and flexible tubular sections, as well as at least a portion of the end piece, have generally commensurate inner and outer diameters. A tubular, rigid cover member, having an associated length greater than an associated length of the flexible tubular section, is slidable mounted between a first position wherein the cover member extends between the rigid tubular section and the end piece in order to maintain the flexible tubular section in a straight posture and a second position wherein the cover member extends about the rigid tubular section such that the flexible tubular member is exposed. In a preferred embodiment, a retaining member is provided to selectively maintain the cover member in a desired position.

The attachment is further provided with a handle member which is detachably mounted to the rigid tubular section. When the cover member is placed in its second position, the handle member can be used to maintain the flexible tubular section in a curved posture. According to a first preferred embodiment, the handle member is constituted by a rigid arcuate member that is provided with an arcuate slot adapted to receive the flexible tubular member such that the arcuate shape of the handle member defines the curved posture for the flexible tubular member. A second embodiment for the handle member incorporates a pair of resilient split-ring clamps and a connecting strip extending between the clamps. The clamps are adapted to be attached to the rigid tubular section with the connecting strip extending therebetween when the cover member is in its first position and to be attached adjacent the juncture of the flexible tubular section with the rigid tubular section, as well as the juncture of the flexible tubular section and the end piece, when the cover member is in its second position. In this second position, the connecting strip, which is much shorter in length than the flexible tubular section, again extends between the clamps in order to maintain the flexible tubular member in a curved posture.

When in a straight posture, the attachment of the present invention can be used as a rigid extension for cleaning purposes and can easily be manipulated by a user by means of the handle member. When the flexible tubular section is exposed, the attachment can be advantageously used for other cleaning purposes with the flexible section aiding in maneuvering the end piece. In addition, the flexible tubular section can be placed in a predetermined curved posture with the use of the handle member such that the attachment can be effectively used as a cleaning tool in other environments, such as in cleaning out gutters, atop doorways, above curtains, etc.

Additional features and advantages of the pneumatic cleaning device attachment of the present invention will become more readily apparent from the following detail description of the preferred embodiments thereof, when taken in conjunction with the drawings wherein like reference numerals refer to corresponding parts in the several views.

DETAILED DESCRIPTION OF THE PREFERRED EMBODIMENTS

Figure 1:
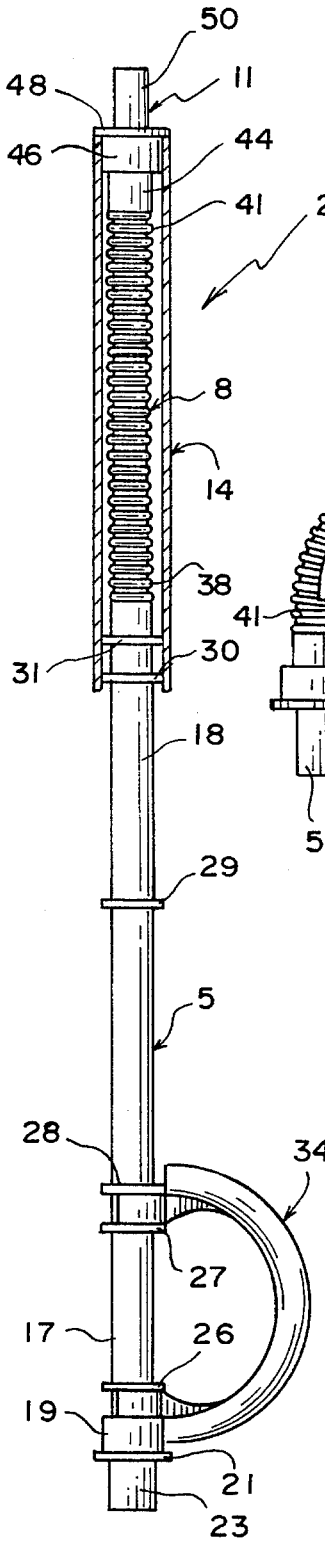
FIG. 1 is a partial cross-sectional view of the pneumatic cleaning device attachment of the present invention in a first in-use position.

With initial reference to FIG. 1, the cleaning attachment of the present invention is generally indicated at 2. Cleaning attachment 2 includes an elongated rigid tubular member 5, a flexible tubular member 8, a rigid tubular end piece 11 and a tubular rigid cover member 14.

More specifically, rigid tubular member 5 includes a first end portion 17 and a second end portion 18. First end portion 17 incorporates an enlarged diametric section 19, that terminates in a first annular header member 21, and an attachment section 23. Rigid tubular member 5 is provided with a plurality of longitudinally spaced, integral annular flanges 26–31. In the preferred embodiment of the invention, each annular flange 26–31 evinces an outer diameter substantially equal to the outer diameter of enlarged diametric section 19. As illustrated in FIG. 1, cleaning attachment 2 further includes a handle member 34 as will be more fully discussed below.

Flexible tubular member 8 includes a first end 38 that is fixedly secured to second end portion 18 of rigid tubular member 5 such that flexible tubular member 8 constitutes an extension of rigid tubular member 5. Flexible tubular member 8 further includes a second end 41 that is fixedly secured to a first section 44 of tubular end piece 11. First section 44 of tubular end piece 11 leads to an enlarged diametric section 46 that terminates in a second annular header member 48. Tubular end section 11 terminates in a nozzle 50.

Figure 2:
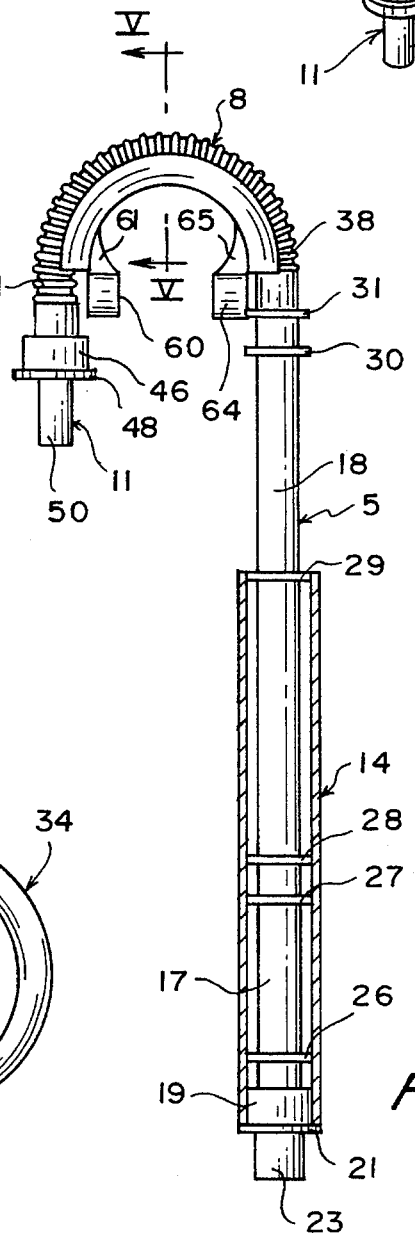
FIG. 2 is a partial cross-sectional view of the attachment in another in-use position.
Figure 3:
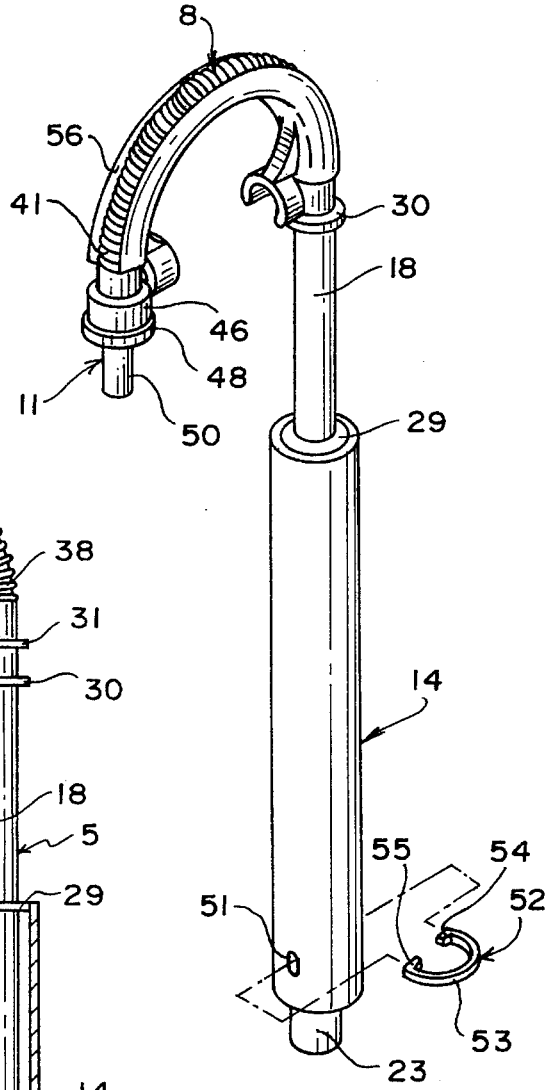
FIG. 3 is a perspective view of the attachment in the in-use position of FIG. 2, along with a removable retaining member.
Figure 4:
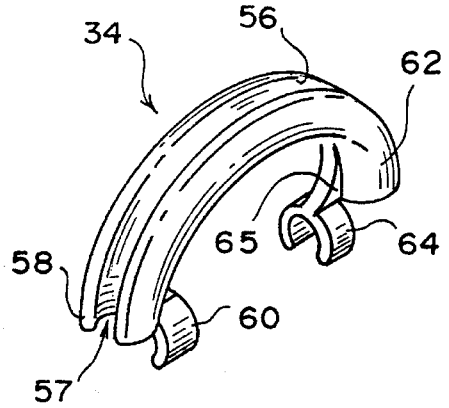
FIG. 4 is a perspective view of a handle member incorporated in a first preferred embodiment of the attachment of the present invention.
Figure 5:
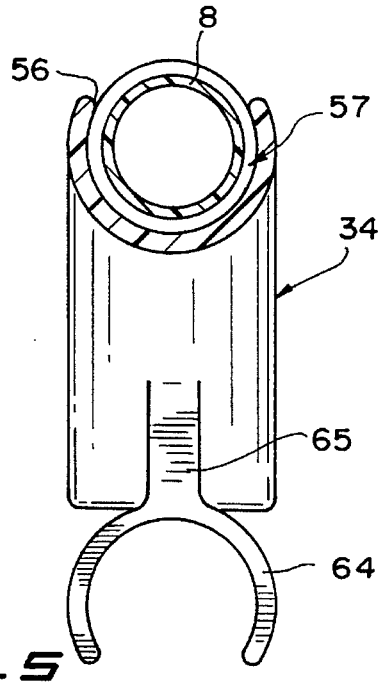
FIG. 5 is a cross-sectional view generally taken along line V—V in FIG. 2.

Rigid cover member 14 is slidably mounted between the positions shown in FIG. 1 and the position illustrated in each of FIGS. 2 and 3. More specifically, rigid cover member 14 can be positioned such that it abuts second annular header member 48 and extends about second end portion 18 of rigid tubular member 5 as depicted in FIG. 1 or abuts first annular header member 21 and extends about a predetermined length of rigid tubular member 5 as illustrated in FIGS. 2 and 3. In the position illustrated in FIG. 1, rigid cover member 14 entirely encapsulates flexible tubular member 8 such that cleaning attachment 2 substantially constitutes an elongated rigid cleaning attachment. In this configuration, attachment section 23 can be attached to a pneumatic power source, such as a blower or vacuum source, either directly or through another flexible tubular section (not shown). Handle member 34 would then be used to manipulate cleaning attachment 2.

As should be clearly evident from viewing FIGS. 1 and 2, rigid cover member 14 has an associated outer diameter that is only slightly greater than the outer diameter of each of enlarged diametric section 19, each annular flange 26–31 and enlarged diametric section 46. With this construction, rigid cover member 14 can readily slide between the position illustrated in FIG. 1 and the position illustrated in each of FIGS. 2 and 3. In accordance with the invention, rigid cover member 14 can be sized so as to be frictionally maintained in either of the positions illustrated in these figures but still can be readily, manually shifted or cover member 14 can be provided with diametrically opposing apertures, one of with is indicated in FIG. 3 at 51, which cooperate with a retaining member 52 for maintaining rigid cover member 14 in a desired position. More specifically, retaining member 52 includes an arcuate body portion 53 that terminates in inwardly projecting and identically constructed tabs 54 and 55.

With this construction, retaining member 52 can be positioned about cover member 14 such that each tab 54, 55 extends into a respective aperture 51 such that, when cover member 14 is in the position shown in FIG. 1, tabs 54 and 55 will abut annular flange 31 on a side adjacent first end 38 of flexible tubular member 8 to prevent movement of cover member 14 towards handle member 34. In addition, when cover member 14 is in the position shown in FIGS. 2 and 3, tabs 54 and 55 will be positioned on the side of annular flange 26 adjacent enlarged diametric section 19 to prevent movement of rigid cover member 14 from undesirably shifting toward end piece 11. To aid in inserting and removing retaining member 52, tabs 54 and 55 preferably include front and rear angled surfaces (not labeled).

Of course, it is to be understood that other means (not shown) could be provided to selectively maintain rigid cover member 14 in either of its in-use positions. For example, annular flange 30 and the corresponding inner diametric portion of rigid cover member 14, as well as enlarged diametric portion 19 and this inner diametric portion at the other end of rigid cover member 14 could be releasably attached to each other in order to positively retain rigid cover member 14 in its desired in-use position. For example, these elements could be threaded such that, once rigid cover member is slid almost entirely to its desired in-use position, it would then be rotated to provide the desired threaded connection or a simple latch arrangement could be provided.

In the preferred embodiment of the invention, cleaning attachment 2 is entirely formed from molded plastic with rigid tubular member 5, flexible tubular member 8 and tubular end piece 11 having substantially identical internal diameters, although the inner diameter of nozzle 50 is preferably slightly reduced and the inner diameter of attachment section 23 is slightly enlarged. The actual associated inner diameters of these elements can vary greatly without departing from the spirit of the invention, however, such diameters would generally range between 1.5 inches and 3 inches.

In the embodiment depicted in FIGS. 1–5, handle member 34 constitutes a rigid arcuate member preferably formed from molded plastic. Handle member 34 is provided with an arcuate slot 56 about an outer circumferential portion thereof so as to define an internal cavity 57. Arcuate slot 56 terminates in a first open end 58, adjacent to which a first clip member 60 is integrally molded through a first gusset 61, and a second open end 62 adjacent to which a second clip member 64 is integrally molded through a second gusset 65. Clip members 60 and 64 are adapted to be selectively snapped between enlarged diametric section 19 and first annular flange 26 and second and third annular flanges 27 and 28 respectively when cleaning attachment 2 assumes the in-use position shown in FIG. 1.

Figure 6:
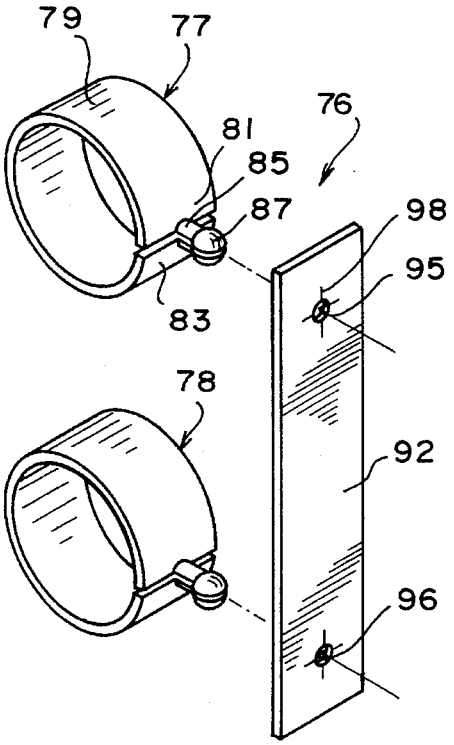
FIG. 6 is an exploded perspective view of a second preferred embodiment for the handle member of the present attachment.
Figure 7:
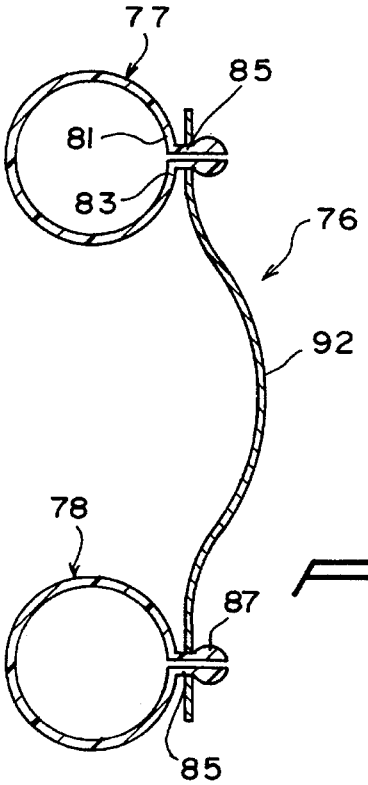
FIG. 7 is a cross-sectional view of the handle member of FIG. 6 in its assembled state.

When it is desired to allow flexible tubular member 8 of cleaning attachment 2 to flex, rigid cover member 14 is slid to the position shown in FIG. 2 in the manner described above. Of course, clip members 60 and 64 of handle member 34 must be detached from rigid tubular member 5 prior to fully shifting rigid cover member 14 to this second in-use position. At this stage, cleaning attachment 2 can be manually manipulated for various cleaning purposes with flexible tubular member 8 enabling cleaning attachment 2 to be readily maneuvered around objects and to clean tight places. If it is desired to clean other surfaces, such as horizontal surfaces or the like, it may be desired to arrange cleaning attachment 2 in a rigid configuration but with nozzle 50 pointing in the same direction as attachment section 23 as illustrated in FIGS. 2 and 3. To accomplish this purpose, flexible tubular member 8 can simply be snapped into cavity 57 through arcuate slot 56 as clearly shown in FIGS. 2 and 3. Since first and second clip members 60 and 64 are only attached inwardly of first and second open ends 58 and 62 respectively, clip members 60 and 64 are offset from the arcuate axis defined by cavity 57 such that clip members 60 and 64 will not interfere with flexible tubular member 8. This feature of the invention is best illustrated in FIGS. 2 and 3o At this point, it should be realized that various other methods of attaching handle member 34 to rigid tubular member 5 could readily be incorporated in accordance with the invention. It should only be important to note that handle member 34 performs a dual function in accordance with the present invention such that it can be used to manipulate cleaning attachment 2 when cleaning attachment 2 assumes the position as shown in FIG. 1 and maintains flexible tubular member 8 in a desired arcuate configuration when cleaning attachment 2 assumes the in-use position shown in FIGS. 2 and 3. For example, FIGS. 6 and 7 illustrate another preferred embodiment of a handle member 76 that can be used in the cleaning attachment 2 of the present invention. As illustrated in these Figures, handle member 76 includes a pair of resilient split-ring clamps 77 and 78, each of which is defined by a body portion 79 having first and second ends 81 and 83. Each end 81, 83 has integrally molded therewith, at a central location, a semi-cylindrical shank portion 85 having a terminal end 87 defined by a hemispherical head. With this construction, when first and second ends 81 and 83 of each split-ring clamp is squeezed together, the semi-cylindrical shank portion at first end 81 and the semi-cylindrical shank portion at second end portion 83 mate, along with the respective hemispherical heads provided at first and second ends 81 and 83, such that they combine to form a cylindrical shank and a spherical head for each split-ring clamp 77, 78.

Handle member 76 also includes a flexible connecting strip 92. Connecting strip 92 is provided with two longitudinally spaced apertures 95 and 96, each of which is slitted such as at 98. In accordance with this embodiment, each split-ring clamp 77, 78 can be placed around rigid tubular member 5, between enlarged diametric section 19 and first annular flange 26 and between second and third annular flanges 27 and 28 respectively, and connecting strip 92 can be extended between the split-ring clamps 77 and 78 with apertures 95 and 96 receiving the respective mating hemispherical heads 89 (see FIG. 7). In this embodiment, split-ring clamps 77 are preferably formed from plastic and connecting strip 92 is preferably formed from rubber.

It should be noted that handle member 76 in accordance with this second embodiment also functions to maintain flexible tubular member 8 in a desired arcuate configuration, in a manner similar to handle member 34 as shown in FIGS. 2 and 3, by simply placing split-ring clamps 77 about first and second end 38 and 41 of flexible tubular member 8, or directly adjacent thereto, and attaching connecting strip 92 in the same fashion described above. This will maintain a predetermined distance between the first and second ends 38 and 41 of flexible tubular member 8 that forces flexible tubular member 8 to assume the desired curved posture.

From the above description, it should be readily apparent that the cleaning attachment 2 of the present invention represents a versatile cleaning attachment that can assume various configurations in order to be effectively used in performing various cleaning operations. Cleaning attachment 2 can be configured as an elongated rigid member that can advantageously be used for various purposes such as with a pneumatic blower, can be used with flexible tubular member 8 providing ease of maneuverability with rigid cover member 14 in the position shown in FIGS. 2 and 3 (without the handle attached as shown in these Figures) or can assume an in-use position with flexible tubular member 8 assuming a predetermined arcuate configuration in the manner described above. In this configuration, cleaning attachment 2 can be used to clean high shelves, above doorways, and can even be attached to tubular extensions for cleaning household gutters and the like.

Although described with respect to preferred embodiments of the invention, it should be readily understood that various changes and/or modifications may be made to the present invention without departing from the spirit thereof. In general, the invention is only intended to be limited by the scope of the following claims.

We claim:

1. An attachment for a pneumatic cleaning device comprising:

an elongated, rigid tubular member having a first end portion and a second end portion, the first end portion of said rigid tubular member being adapted to be attached to a pneumatic cleaning device;

a flexible tubular member having an associated length and including a first end and a second end, the first end of said flexible tubular member being attached to the second end portion of said rigid tubular member;

a rigid, tubular end piece being attached to the second end of said flexible tubular member, said end piece terminating at a portion remote from said flexible tubular member in a nozzle portion; and a tubular, rigid cover member having an associated length that is longer than the associated length of said flexible tubular member, said cover member defining an associated inner diameter that is greater than an associated outer diameter of each of said rigid tubular member and said flexible tubular member, said cover member being movably mounted between a first position wherein said cover member extends between the second end portion of said rigid tubular member and said end piece and about said flexible tubular member in order to maintain said flexible tubular member in a straight posture and a second position wherein said cover member extends about said rigid tubular member in order to enable said flexible tubular member to assume a curved posture.

2. An attachment for a pneumatic cleaning device according to claim 1, further comprising means for maintaining said flexible tubular member in a predetermined curved posture.

3. An attachment for a pneumatic cleaning device according to claim 2, wherein said maintaining means comprises a rigid, arcuate member adapted to be removably secured onto said flexible tubular member.

4. An attachment for a pneumatic cleaning device according to claim 3, wherein said arcuate member includes an arcuate slot adapted to receive said flexible tubular member.

5. An attachment for a pneumatic cleaning device according to claim 3, wherein said arcuate member carries means for removably attaching said arcuate member to said rigid tubular member when said cover member is in said first position such that said arcuate member also functions as a handle for said attachment.

6. An attachment for a pneumatic cleaning device according to claim 5, wherein said means for removably attaching comprises a pair of clip members, each of said clip members being provided adjacent a respective end of said arcuate member.

7. An attachment for a pneumatic cleaning device according to claim 2, wherein said maintaining means comprises a pair of resilient split-ring clamps, each being adapted to be fixed to said attachment adjacent a first juncture between said flexible tubular member and said rigid tubular member and a second juncture between said flexible tubular member and said end piece, and a connecting strip interconnecting said split-ring clamps.

8. An attachment for a pneumatic cleaning device according to claim 7, wherein each of said split-ring clamps comprises a body portion having first and second ends, a shank portion extending substantially perpendicular from each of said first and second ends of said body portion and a head portion provided at a terminal end of each of said shank portions, said connecting strip including a pair of spaced apertures for removably receiving the head portions of said split-ring clamps.

9. An attachment for a pneumatic cleaning device according to claim 8, wherein each said shank portion is semi-cylindrical in shape and each said head portion is hemispherically shaped such that, when the shank portions and head portions provided at the first and second ends of the body portion of either of said split-ring clamps are brought together, the shank portions mate to define a cylindrical body and said head portions mate to define a spherical body.

10. An attachment for a pneumatic cleaning device according to claim 1, further comprising means for retaining said cover member in a selected one of said first and second positions.

11. An attachment for a pneumatic cleaning device comprising:

an elongated, rigid tubular member having a first end portion and a second end portion, the first end portion of said tubular member being adapted to be attached to a pneumatic cleaning device;

a flexible tubular member having a first end and a second end, the first end of said flexible tubular member being attached to the second end portion of said rigid tubular member;

a rigid, tubular end piece being attached to the second end of said flexible tubular member, said end piece terminating at a portion remote from said flexible tubular member in a nozzle portion; and means for selectively maintaining said flexible tubular member in a predetermined curved posture, said maintaining means being movable between a first position wherein said maintaining means is readily detachably secured adjacent the first and second ends of said flexible tubular member to maintain said flexible tubular member in said predetermined curved posture and a second position wherein said maintaining means is located remote from said end piece.

12. An attachment for a pneumatic cleaning device according to claim 11, wherein said maintaining means comprises a rigid, arcuate member that includes an arcuate slot adapted to receive said flexible tubular member.

13. An attachment for a pneumatic cleaning device according to claim 11, wherein said maintaining means comprises a pair of resilient split-ring clamps, each being adapted to be fixed to said attachment adjacent the connection of said flexible tubular member to said rigid tubular member and said end piece respectively, and a connecting strip interconnecting said split-ring clamps.

14. An attachment for a pneumatic cleaning device according to claim 13, wherein each of said split-ring clamps comprises a body portion having first and second ends, a shank portion extending substantially perpendicular from each of said first and second ends of said body portion and a head portion provided at a terminal end of each of said shank portions, said connecting strip including a pair of spaced apertures for removably receiving the head portions of said split-ring clamps.

15. An attachment for a pneumatic cleaning device according to claim 14, wherein each said shank portion is semi-cylindrical in shape and each said head portion is semi-hemispherically shaped such that, when the shank portions and head portions provided at the first and second ends of the body portion of either of said split-ring clamps are brought together, the shank portions mate to define a cylindrical body and said head portions mate to define a spherical body.

16. An attachment for a pneumatic cleaning device according to claim 11, further comprising a tubular, rigid cover member having an associated length that is longer than an associated length of said flexible tubular member, said cover member defining an associated inner diameter that is greater than an associated outer diameter of each of said rigid tubular member and said flexible tubular member, said cover member being movably mounted between a first position wherein said cover member extends between the second end portion of said rigid tubular member and said end piece and about said flexible tubular member in order to maintain said flexible tubular member in a straight posture and a second position wherein said cover member extends about said rigid tubular member in order to enable said flexible tubular member to assume a curved posture.

17. An attachment for a pneumatic cleaning device according to claim 16, further comprising means for retaining said cover member in a selected one of said first and second positions.

18. An attachment for a pneumatic cleaning device according to claim 16, wherein said arcuate member carries means for removable attaching said arcuate member to said rigid tubular member when said cover member is in said first position such that said arcuate member also function as a handle for said attachment.

19. An attachment for a pneumatic cleaning device according to claim 18, wherein said means for removably attaching comprises a pair of clip members, each of said clip members being provided at a respective end of said arcuate member.

* * * * *